US010807381B2

(12) United States Patent
Fujita

(10) Patent No.: US 10,807,381 B2
(45) Date of Patent: Oct. 20, 2020

(54) RECORDING DEVICE AND RECORDING METHOD

(71) Applicant: SEIKO EPSON CORPORATION, Tokyo (JP)

(72) Inventor: Toru Fujita, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/364,567

(22) Filed: Mar. 26, 2019

(65) Prior Publication Data

US 2019/0299651 A1 Oct. 3, 2019

(30) Foreign Application Priority Data

Mar. 28, 2018 (JP) ..... 2018-061406

(51) Int. Cl.

| | |
|---|---|
| ***B41J 2/045*** | (2006.01) |
| ***B41J 2/21*** | (2006.01) |
| ***B41J 2/205*** | (2006.01) |
| ***B41J 25/308*** | (2006.01) |

(52) U.S. Cl.

CPC ..... *B41J 2/2128* (2013.01); *B41J 2/04581* (2013.01); *B41J 2/04593* (2013.01); *B41J 2/2054* (2013.01); *B41J 2/2132* (2013.01); *B41J 25/3088* (2013.01)

(58) Field of Classification Search

CPC .... B41J 2/04516; B41J 2/205; B41J 2/20554; B41J 2/2056; B41J 2/21; B41J 2/2121; B41J 2/2128; B41J 2/2132; B41J 2/2146

See application file for complete search history.

(56) References Cited

U.S. PATENT DOCUMENTS

2006/0125853 A1* 6/2006 Misumi ..... B41J 2/2128 347/5
2010/0177137 A1* 7/2010 Kakutani ..... B41J 2/2132 347/15

(Continued)

FOREIGN PATENT DOCUMENTS

JP 2014-180801 A 9/2014
JP 2016-175378 A 10/2016

OTHER PUBLICATIONS

Extended European Search Report dated Jul. 25, 2019 in related European Appl. 19165238.7 (24 pgs.).

*Primary Examiner* — Scott A Richmond
(74) *Attorney, Agent, or Firm* — Chip Law Group

(57) ABSTRACT

A recording device includes a recording head (a printing head) with multiple nozzles arranged therein to discharge droplets (ink droplets) onto a recording medium (a printing medium), and a recording controller (a printing controller) configured to control recording of a recording image, the recording including moving the recording head relative to the recording medium while the droplets are discharged. The recording controller is configured to control the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable.

5 Claims, 13 Drawing Sheets

(56) References Cited

U.S. PATENT DOCUMENTS

| | | | | |
|---|---|---|---|---|
| 2011/0141502 | A1* | 6/2011 | Narumi | B41J 2/205<br>358/1.9 |
| 2014/0285546 | A1* | 9/2014 | Furuta | B41J 2/04503<br>347/9 |
| 2016/0279935 | A1 | 9/2016 | Yuda | |

* cited by examiner

DOT GENERATION RATE TABLE

| | DOT GENERATION RATE (THE NUMBER OF GENERATED DOTS) | | |
|---|---|---|---|
| INPUT GRAY SCALE VALUE | SMALL DOTS | MEDIUM DOTS | LARGE DOTS |
| 0 | s(0) | m(0) | l(0) |
| ⋮ | ⋮ | ⋮ | ⋮ |
| 158 | s(158) | m(158) | l(158) |
| 159 | s(159) | m(159) | l(159) |
| 160 | s(160) | m(160) | l(160) |
| 161 | s(161) | m(161) | l(161) |
| ⋮ | ⋮ | ⋮ | ⋮ |
| 255 | s(255) | m(255) | l(255) |

Fig. 4

RECORDING DEVICE AND RECORDING METHOD

BACKGROUND

1. Technical Field

The invention relates to a recording device discharging droplets onto a recording medium for recording and a recording method.

2. Related Art

An ink jet-type printer is an example of a known recording device, and discharges droplets (ink droplets) toward any of various recording media such as paper and films to form multiple dots on the recording medium for recording (printing) of an image. An ink jet-type printer of, for example, a serial head type alternately repeats main scanning and sub-scanning; the main scanning involves moving a head provided with multiple nozzles, in a main scanning direction with respect to a recording medium, while discharging droplets through the nozzles to form multiple dot lines (raster lines) arranged in the main scanning direction of the recording medium, and the sub-scanning involves moving (conveying) the recording medium in a sub-scanning direction intersecting with the main scanning direction. The dots are thus closely arranged in the main scanning direction and the sub-scanning direction of the recording medium to form an image on the recording medium.

In such a recording device, when the main scanning is executed with simultaneous discharge at a high nozzle duty of 100% or close to 100% (in other words, the recording has a high gray scale value), droplets may be simultaneously discharged through all the nozzles or many neighboring nozzles or discharge of droplets may occur with a short discharge period, possibly leading to non-negligible airflows (air turbulence) on a recording surface. The airflows may affect flying trajectories of ink droplets, notably satellite droplets (droplets with a small mass resulting from droplet discharge), possibly leading to density unevenness in an image formed on the recording medium (an image defect resulting from such density unevenness is hereinafter referred to as "wind ripples"). Such wind ripples may occur not only in the serial head type ink jet-type printer, in which recording includes the main scanning of the head, but also in an ink jet-type printer of a line head type including a fixed head. This is because, even without the main scanning, non-negligible airflows may result from simultaneous discharge of droplets through all the nozzles (or many neighboring nozzles) or discharge with a short discharge period.

In contrast, JP-A-2016-175378 describes a recording device causing a head to execute multiple main scanning operations to discharge droplets from nozzles onto a recording medium. In a case where a first area of each of nozzle rows in the recording device is defined as an area from a nozzle at a first end to a first nozzle positioned at a first prescribed distance from the nozzle at the first end, a second area of the nozzle row is defined as an area from a nozzle at a second end opposite to the first end to a second nozzle positioned at a second prescribed distance from the nozzle at the second end, and a third area of the nozzle row is defined as an area between the first area and the second area, then raster lines formed by the nozzles in the third area each include a decimated portion.

For example, in a case of forming an image through three main scanning operations with the first area and the second area overlapping each other, this recording device executes decimated recording (decimated printing) in which some of the discharging nozzles are decimated in the nozzles in the third area. This prevents droplets from being discharged simultaneously through all the nozzles in the third area, thus reducing the intensity of airflows affecting the flying trajectories of satellite droplets. This in turn inhibits possible wind ripples resulting from the airflows.

JP-A-2016-175378 describes a recording device in which the decimated portions are present not only in the raster lines formed by the nozzles in the third area but also in each of raster lines formed by the nozzles in the first area and the second area.

This recording device executes even decimation on the entire image to inhibit possible wind ripples and to allow suppression of visual recognition of gray scale unevenness resulting from decimation of dots formed by the nozzles in the third area.

However, the recording devices described in JP-A-2016-175378 decimate dots at all gray scale values (i.e., even at gray scales where no wind ripples are likely to occur), and thus, recording quality may disadvantageously be degraded; for example, degraded granularity or increased gray scale errors may result.

SUMMARY

An aspect of the application provides a recording device including a recording head including multiple nozzles arranged therein to discharge droplets onto a recording medium, and a recording controller configured to control recording of a recording image, the recording including moving the recording head relative to the recording medium while the droplets are discharged, wherein the recording controller is configured to control the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable.

In the recording device, the recording controller is preferably configured to control the recording under a condition that, for the pixel data having the prescribed gray scale value or larger, the nozzle duty is constant.

In the recording device, the recording controller is preferably configured to control the recording under a condition that, for the pixel data having the prescribed gray scale value or larger, a size of the droplet is increased in accordance with an increase in a gray scale value of the recording image.

In the recording device, the recording controller is preferably configured to change the prescribed gray scale value and the upper limit value, depending on a distance between the recording head and the recording medium, to control the recording.

The recording device described above preferably includes an input unit configured to input an upper limit value change instruction, wherein the recording controller is configured to change the upper limit value and the prescribed gray scale value, based on the upper limit value change instruction received from the input unit, to control the recording.

An aspect of the application provides a recording method for recording a recording image by discharging droplets onto a recording medium from a recording head including multiple nozzles, configured to discharge droplets onto a recording medium, arranged therein while the recording head and the recording medium are moved relative to each other, the recording method including executing the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable.

BRIEF DESCRIPTION OF THE DRAWINGS

The invention will be described with reference to the accompanying drawings, wherein like numbers reference like elements.

FIG. 4 is an explanatory view of a dot generation rate table.

DESCRIPTION OF EXEMPLARY EMBODIMENTS

Figure 1:
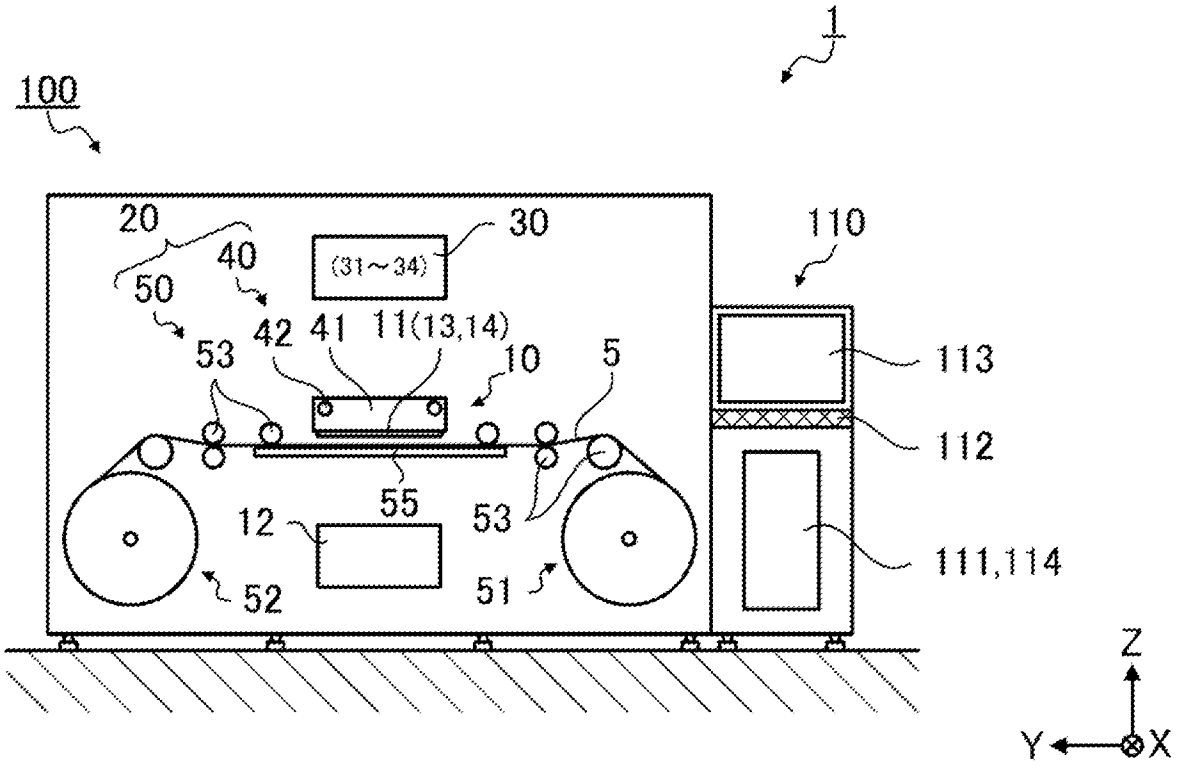
FIG. 1 is a front view illustrating a configuration of a recording device according to Exemplary Embodiment 1.

With reference to the drawings, description is given below of exemplary embodiments of the invention. The following is an exemplary embodiment of the invention and is not intended to limit the invention. Note that the respective drawings may be illustrated not-to-scale, for illustrative clarity. Also, as for coordinates given in the drawings, it is assumed that a Z-axis direction is an up/down direction, a +Z direction is an upward direction, an X-axis direction is a front/rear direction, a −X direction is a frontward direction, a Y-axis direction is a left/right direction, a +Y direction is a leftward direction, and an X-Y plane is a horizontal plane.

Exemplary Embodiment 1

Figure 2:
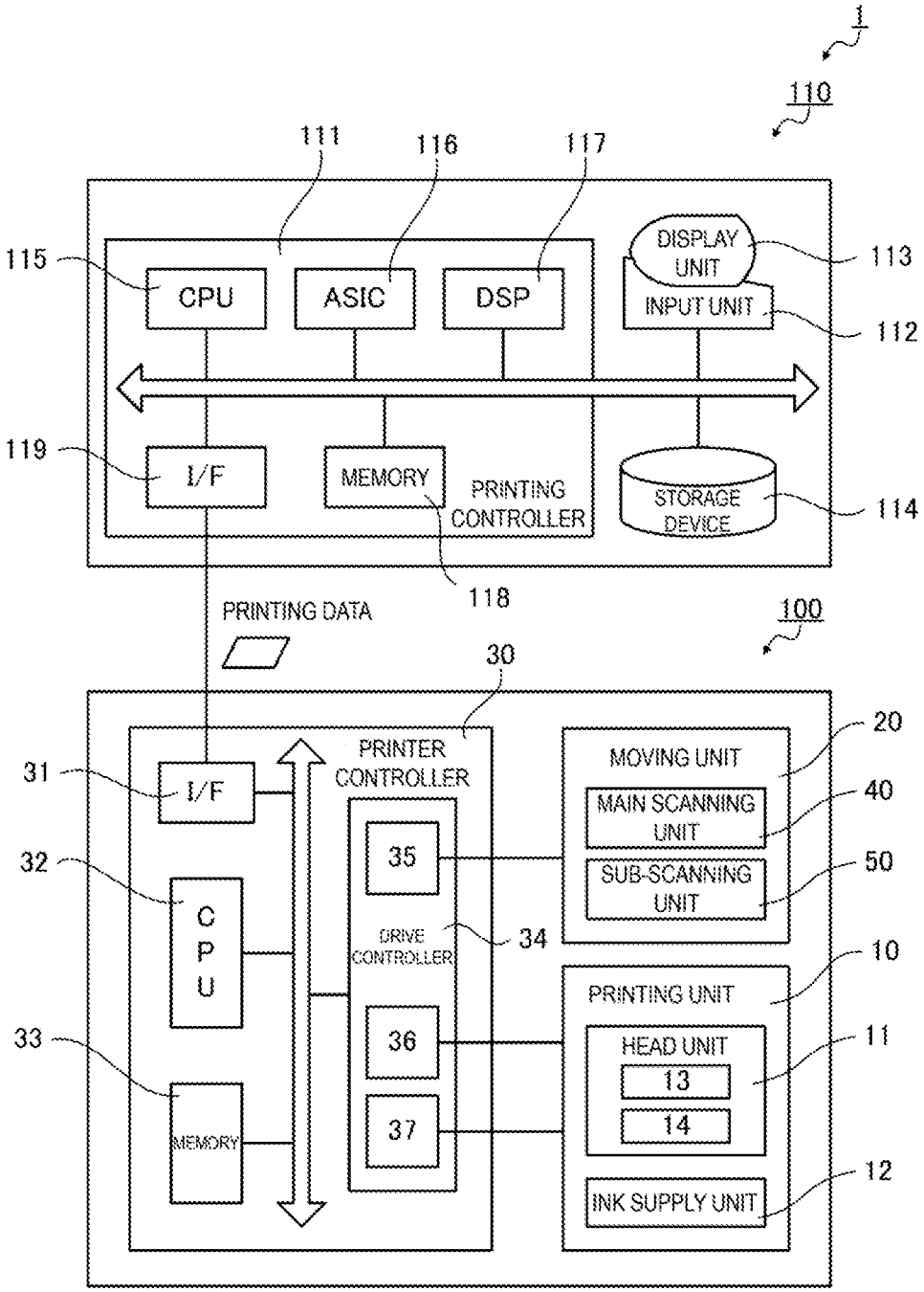
FIG. 2 is a block diagram illustrating the configuration of the recording device according to Exemplary Embodiment 1.

FIG. 1 is a front view illustrating a configuration of a printing system 1 serving as a "recording device" according to Exemplary Embodiment 1, and FIG. 2 is a block diagram of the printing system 1. Printing of images, characters, or symbols, which is an aspect of "recording," will be described. Note that the "recording" includes, besides the printing of images, characters, or symbols, recording of digital information based on application of droplets to desired positions on a recording medium and application of constituent materials or shaping materials of a product.

The printing device 1 includes a printer 100, and an image processor 110 connected to the printer 100. The printer 100 is an ink jet serial printer that prints a desired image on a printing medium 5 that is a long-length "recording medium" supplied in a roll shape, based on printing data received from the image processor 110.

The printing medium 5 may be, for example, woodfree paper, cast coated paper, art paper, coat paper, and synthetic paper. Furthermore, the printing medium 5 is not limited to such paper, and may be, for example, a cloth or a film formed of polyethylene terephthalate (PET), polypropylene (PP) or the like.

Basic Configuration of Image Processor

The image processor 110 includes a printing controller 111 serving as a "recording controller," an input unit 112, a display unit 113, and a storage device 114, and controls print jobs causing the printer 100 to execute printing. In a preferred example, the image processor 110 is configured using a personal computer.

Software operated by the image processor 110 includes general image processing application software (hereinafter referred to as an application) that deals with the image data to be printed, and printer driver software (hereinafter, referred to as a printer driver) that generates printing data for controlling the printer 100 and causing the printer 100 to execute printing.

Here, the image data refers to text data or full-color image data constituting a "recording image," such as typical RGB digital image information. The "recording image" will be described as image data.

The printing controller 111 includes a Central Processing Unit (CPU) 115, an Application Specific Integrated Circuit (ASIC) 116, a Digital Signal Processor (DSP) 117, a memory 118, and a printer interface (I/F) unit 119, and performs centralized management of the entire printing system 1.

The input unit 112 is an information input means serving as a human interface. Specifically, the input unit 112 is, for example, a port or the like for connecting a keyboard, a mouse pointer, or an information input device.

The display unit 113 is an information display means (display) serving as a human interface, and displays information input from the input unit 112, images to be printed on the printer 100, and information related to the print job, and the like, under the control of the printing controller 111.

The storage device 114 is a rewritable storage medium such as a hard disk drive (HDD) or a memory card, and stores software run by the image processor 110 (programs run by the printing controller 111), an image to be printed, information about the print job, and the like.

The memory 118 is a storage medium that secures a region for storing programs run by the CPU 115, a work region in which such programs run, and the like, and includes storage elements such as a RAM and an EEPROM.

Basic Configuration of Printer 100

The printer 100 includes a printing unit 10, a moving unit 20, and a printer controller 30. The printer 100 that has received the printing data from the image processor 110 controls, by the printer controller 30, the printing unit 10 and the moving unit 20 based on the printing data to print (form) an image on the printing medium 5.

The printing data is data for image formation acquired by subjecting, for example, typical image data acquired by a digital camera or the like to conversion processing to enable the data to be printed by the printer 100 using the application and a printer driver provided in the image processor 110, and includes a command for controlling the printer 100.

The printing unit 10 includes a head unit 11, and an ink supply unit 12.

The moving unit 20 includes a main scanning unit 40, and a sub-scanning unit 50. The main scanning unit 40 includes a carriage 41, a guide shaft 42, and a carriage motor (not illustrated). The sub-scanning unit 50 includes a supply unit 51, a housing unit 52, a conveying roller 53, and a platen 55.

The head unit 11 includes a printing head 13 serving as a "recording head" including multiple nozzles (nozzle rows) for discharging, as ink droplets, printing ink (hereinafter referred to as ink) corresponding to a "liquid," and a head controller 14. The head unit 11 is mounted on the carriage 41, and moves back and forth in a main scanning direction (X-axis direction illustrated in FIG. 1) along with the carriage 41 that moves in the main scanning direction. The head unit 11 (printing head 13) discharges ink droplets onto the printing medium 5 supported by the platen 55 under the control of the printer controller 30 while moving in the main scanning direction, and thus a row of dots (raster line) along the main scanning direction is formed on the printing medium 5.

The term "pass operation" or simply "pass" as used herein refers to an operation of discharging ink through the nozzle rows while moving in the main scanning direction to form dots. One pass operation means dot formation involved in a single movement in the main scanning direction. Partial images each printed as a result of the dot formation involved in a single movement in the main scanning direction are combined together in a sub-scanning direction (a Y-axis direction illustrated in FIG. 1) intersecting with the main scanning direction to print a desired image based on the image data.

The ink supply unit 12 includes an ink tank, and an ink supply path (not illustrated) that supplies ink from the ink tank to the printing head 13.

Examples of the ink include a four color ink set obtained by adding black (K) to a three color ink set including cyan (C), magenta (M), and yellow (Y), as an ink set of dark ink compositions. Examples of the ink also include an eight color ink set obtained by adding an ink set of light ink compositions, such as light cyan (Lc), light magenta (Lm), light yellow (Ly), and light black (Lk), with reduced concentrations of the respective color materials. The ink tank, the ink supply channel, and an ink supply path to nozzles that discharge the same ink are provided separately for each ink.

As for a technique of discharging ink droplets (ink-jet method), a piezo method is employed. The piezo method is a printing method, in which a pressure corresponding to a printing information signal is applied to the ink stored in a pressure generating chamber by an actuator including a piezoelectric element (piezo element), and ink droplets are ejected (discharged) from a nozzle communicating with the pressure generating chamber.

Note that the technique of discharging ink droplets is not limited to the piezo method and may be any other recording technique of ejecting ink in a form of droplets and forming a dot group on a recording medium. Examples of such a method may include a method of recording by continuously ejecting ink in the form of ink droplets from nozzles by use of an intense electric field between the nozzles and an accelerating electrode provided in front of the nozzles, and by sending a printing information signal from a deflecting electrode while the ink droplets are in flight; a method (electrostatic suction method) in which the ink droplets are ejected, without being deflected, according to the printing information signal; a method in which ink droplets are forcibly ejected by pressurizing ink with a small pump and mechanically vibrating the nozzles with a crystal oscillator or the like; a method (thermal jet method) for recording by heating and foaming ink with a microelectrode according to a printing information signal and thus jetting ink droplets; and the like.

The moving unit 20 (main scanning unit 40, and sub-scanning unit 50) causes the printing medium 5 to move relative to the printing unit 10 under the control of the printer controller 30.

The guide shaft 42 extends in the main scanning direction and supports the carriage 41 in a slidable contact state. The carriage motor serves as a drive source to move the carriage 41 back and forth along the guide shaft 42. That is, the main scanning unit 40 (carriage 41, guide shaft 42, and carriage motor) causes the carriage 41 (that is, the printing head 13) to move in the main scanning direction along the guide shaft 42 under the control of the printer controller 30.

The supply unit 51 rotatably supports a reel on which the printing medium 5 is wounded into a roll, and the supply unit 51 feeds the printing medium 5 into the conveying path. The housing unit 52 rotatably supports a reel, on which the printing medium 5 is wound, and reels off the printing medium 5, on which printing is completed, from the conveying path.

The conveying roller 53 includes a driving roller that causes the printing medium 5 to move on an upper surface of the platen 55 in the sub-scanning direction, and a driven roller that rotates in accordance with the movement of the printing medium 5, and constitutes the conveying path for conveying the printing medium 5 from the supply unit 51 to the housing unit 52 via a printing area (an area where the printing head 13 moves in main scanning for the upper surface of the platen 55) of the printing unit 10.

The printer controller 30 includes an interface unit 31, a CPU 32, a memory 33, and a drive controller 34, and controls the printer 100.

The interface unit 31 is connected to the printer interface unit 119 of the image processor 110 to transmit and receive data between the image processor 110 and the printer 100.

The CPU 32 is an arithmetic processing unit for overall control of the printer 100.

The memory 33 is a storage medium that secures a region for storing programs run by the CPU 32, a work region in which such programs run, and the like, and includes storage elements such as a RAM and an EEPROM.

The CPU 32 controls the printing unit 10 and the moving unit 20 through the drive controller 34 according to the program stored in the memory 33 and the printing data received from the image processor 110.

The drive controller 34 includes firmware operating based on the control of the CPU 32 to control driving of the printing unit 10 (head unit 11, and ink supply unit 12), and the moving unit 20 (main scanning unit 40, and sub-scanning unit 50). The drive controller 34 includes drive control circuits including a transfer control signal generating circuit 35, a discharge control signal generating circuit 36, and a drive signal generating circuit 37, and a ROM and a flash memory (not illustrated) incorporating firmware controlling the drive control circuits.

The transfer control signal generating circuit 35 is a circuit that generates a signal for controlling the moving unit 20 (the main scanning unit 40 and the sub-scanning unit 50), based on the printing data, according to an instruction from the CPU 32.

The discharge control signal generating circuit 36 is a circuit that generates a head control signal for selecting the nozzle for discharging ink, selecting the amount to be discharged, controlling the discharge timing, and the like, based on the printing data in accordance with instructions from the CPU 32.

The drive signal generating circuit 37 is a circuit that generates a drive waveform (drive signal COM) driving a pressure generating unit 72 provided in the printing head 13. The pressure generating unit 72 and the drive signal COM will be described below.

According to the configuration described above, the printer controller 30 forms (prints) a desired image on the printing medium 5 by repeating, with respect to the printing medium 5 supplied to the printing area by the sub-scanning unit 50 (supply unit 51, and conveying roller 53),an operation of discharging ink droplets from the printing head 13 while moving the carriage 41 that supports the printing head 13 along the guide shaft 42 in the main scanning direction (X-axis direction), and an operation of moving, by the sub-scanning unit 50 (conveying roller 53), the printing medium 5 in the sub-scanning direction (+Y-axis direction) intersecting with the main scanning direction.

Basic Functions of Printer Driver

Figure 3:
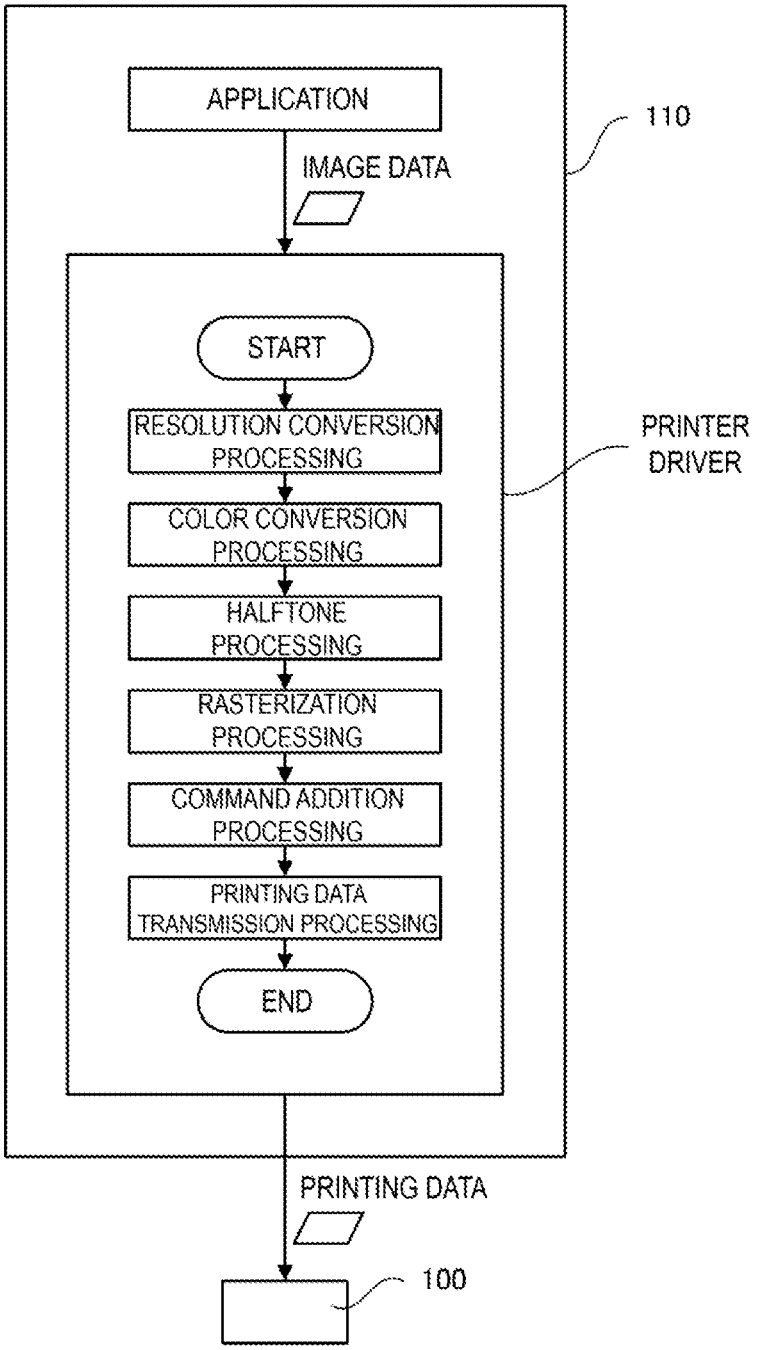
FIG. 3 is an explanatory view of basic functions of a printer driver.

FIG. 3 is an explanatory view of basic functions of the printer driver.

Printing on the printing medium 5 is started by transmitting printing data to the printer 100 from the image processor 110. The printing data is generated by the printer driver.

With reference to FIG. 3, description is given below of printing data generation processing.

The printer driver receives image data from the application, converts the image data into printing data in a format that can be interpreted by the printer 100, and then outputs the printing data to the printer 100. For the conversion of the image data from the application into the printing data, the printer driver performs resolution conversion processing, color conversion processing, halftone processing, rasterization processing, command addition processing, and the like.

The resolution conversion processing is processing of converting the image data output from the application into a resolution for printing (printing resolution) of the printing medium 5. For example, when the printing resolution is specified as 720×720 dpi, vector format image data received from the application is converted into bit map format image data having a 720×720 dpi resolution. Each pixel data of the image data after the resolution conversion processing includes pixels arranged in a matrix pattern. Each pixel has a gray scale value in, for example, 256 gray scales in the RGB color space. That is, each piece of the pixel data after the resolution conversion indicates the gray scale value of the corresponding pixel.

Among the pixels arranged in the matrix pattern, the pixel data corresponding to one row of pixels aligned in a predetermined direction is called raster data. Note that the predetermined direction in which the pixels corresponding to the raster data are aligned corresponds to the direction (main scanning direction) in which the printing head 13 moves when printing an image.

The color conversion processing is processing of converting RGB data into data of a CMYK color system space. CMYK refers to cyan (C), magenta (M), yellow (Y), and black (K). The image data of the CMYK color system space is data corresponding to the colors of the ink of the printer 100. Therefore, when the printer 100 uses eight types of ink of the CMYK color system, the printer driver generates image data in an eight-dimensional space of the CMYK color system based on the RGB data.

This color conversion processing is performed based on a table (color conversion look-up table LUT) in which the gray scale values of the RGB data and the gray scale values of the CMYK color system data are associated with each other. Note that the pixel data after the color conversion processing is, for example, the CMYK color system data of 256 gray scales expressed in the CMYK color system space.

The halftone processing is processing of converting data of a large number of gray scales (256 gray scales) into data of a number of gray scales that can be formed by the printer 100. Through this halftone processing, data expressing 256 gray scales is converted into, for example, 1-bit data expressing two gray scales (dot and no dot) and 2-bit data expressing four gray scales (no dot, small dot, medium dot, and large dot). Specifically, a dot generation rate corresponding to the gray scale value (in the case of four gray scales, a generation rate of each of no dot, small dot, medium dot, and large dot, for example) is obtained from a dot generation rate table in which the gray scale values (0 to 255) and dot generation rates are associated with each other. Then, with the generation rate thus obtained, pixel data is created so that dots are formed in a distributed manner, by using a dither method, an error diffusion method, or the like.

Figure 5:
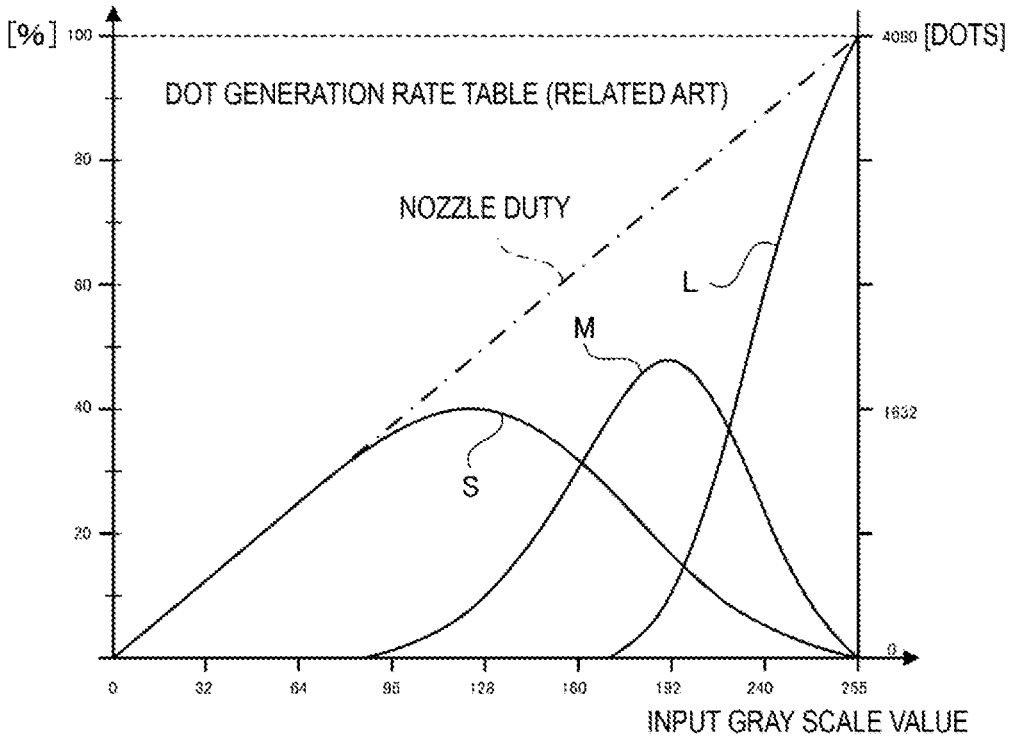
FIG. 5 is an explanatory view of a graph illustrating a dot generation rate table according to the related art.

FIG. 4 illustrates a dot generation rate table for 2 bits (four gray scales). FIG. 5 is a graph illustrating a dot generation rate table according to related art.

The dot generation rate table is a table that associates the gray scale value (hereinafter referred to as the input gray scale value in the description of Exemplary Embodiment) for each pixel included in the image data with a dot generation rate (or the number of generated dots), for each dot size, of dots formed on the printing medium 5 by the printer 100. The dot generation rate table is stored in the memory 33 in the printer 100 for each ink color. An ink discharge amount is the sum of products of the discharged amount per dot for each dot size and the number of dots generated.

A horizontal axis of the graph illustrated in FIG. 5 represents the input gray scale value (0 to 255) indicated by pixel data. A left vertical axis of the graph represents the dot generation rate (0 to 100%). A right vertical axis of the graph represents the number of generated dots (0 to 4080). Furthermore, S denotes small dots, M denotes medium dots, and L denotes large dots.

The dot generation rate at a certain input gray scale value i means a rate of pixels in which a dot is formed (example: n pixels) and which are included in the pixels (example: 4080 pixels) belonging to a unit area on the printing medium 5 in a case where all of the pixel data corresponding to the unit area indicates the input gray scale value i (example: (n/4080)×100). Likewise, the number of generated dots for a certain input gray scale value i means the number of dots formed in the unit area on the printing medium 5 in a case where all of the pixel data corresponding to the unit area indicates the input gray scale value i.

Furthermore, in FIG. 5, a straight line illustrated by an alternate long and short dash line indicates a nozzle duty corresponding to the number of nozzles capable of discharging ink droplets per unit area on the printing medium 5. The nozzle duty indicates the dot generation rate of the total number of dots for each dot size (total number of generated dots). In other words, the input gray scale value and the total dot generation rate (total number of generated dots) are in a linear relationship. Note that the dot generation rate (the number of dots) for a larger dot size increases consistently with input gray scale value and that the ink discharge amount is thus not in a linear relationship with the input gray scale value.

The rasterization processing is processing of rearranging the pixel data (for example, the 1-bit or 2-bit data as described above) in the matrix pattern, according to a dot formation order for printing. The rasterization processing includes pass allocation processing of allocating the image data including the pixel data resulting from the halftone processing to each pass in which the printing head 13 (nozzle rows) discharges ink droplets while moving in the main scanning direction. Once the pass allocation is completed, actual nozzles that form respective raster lines constituting the printing image are allocated.

The command addition processing is processing of adding command data corresponding to a printing method, to the rasterized data. Examples of the command data include sub-scanning data related to sub-scanning specification of the medium (a moving distance and a moving speed on the upper surface of the platen 55 in the sub-scanning direction).

The series of processing by the printer driver is performed by the ASIC 116 and the DSP 117 (refer to FIG. 2) under the control of the CPU 115. Then, in printing data transmission processing, the printing data generated by the series of processing is transmitted to the printer 100 through the printer interface unit 119.

Nozzle Rows

Figure 6:
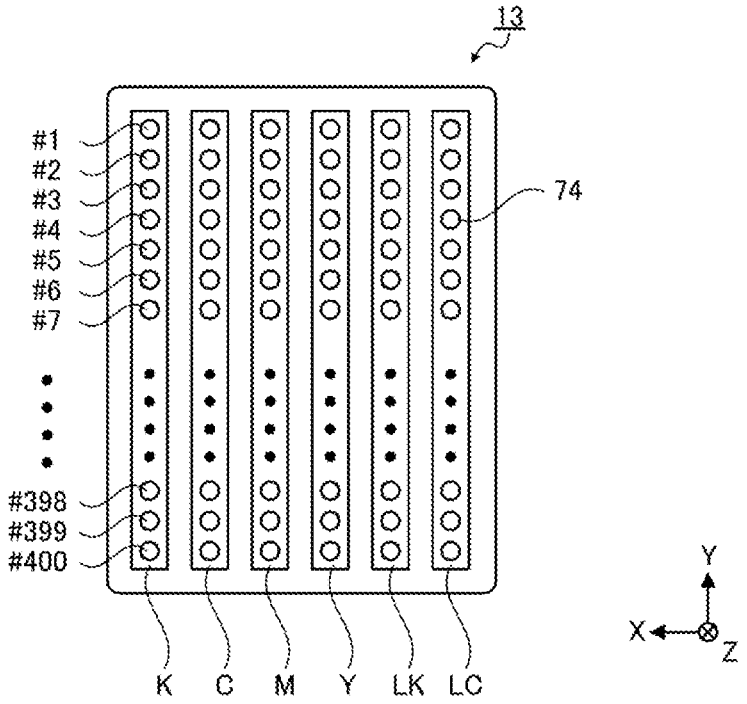
FIG. 6 is a schematic diagram illustrating an example of an array of nozzles.

FIG. 6 is a schematic diagram illustrating an example of arrangement of the nozzles when viewed from a lower surface of the printing head 13.

As illustrated in FIG. 6, the printing head 13 includes nozzle rows each including multiple nozzles 74 arranged in line, the nozzle rows being configured such that inks in different colors are discharged from the respective nozzle rows (in the example illustrated in FIG. 6, a black ink nozzle row K, a cyan ink nozzle row C, a magenta ink nozzle row M, a yellow ink nozzle row Y, a gray ink nozzle row LK, and a light cyan ink nozzle row LC each including 400 nozzles 74 of #1 to #400).

The multiple nozzles 74 of each of the nozzle rows are aligned and lined up at constant intervals (nozzle pitch) along the sub-scanning direction (Y-axis direction) respectively. In FIG. 6, each of the nozzles 74 of each of the nozzle rows is assigned a smaller number as the nozzle 74 is located further downstream in the sub-scanning direction (#1 to #400). That is, the nozzle #1 of the nozzle 74 is located further downstream than the nozzle #400 of the nozzle 74 in the sub-scanning direction. Each of the nozzles 74 is provided with the pressure generating unit 72 for driving the nozzle 74 to discharge ink droplets.

Figure 7:
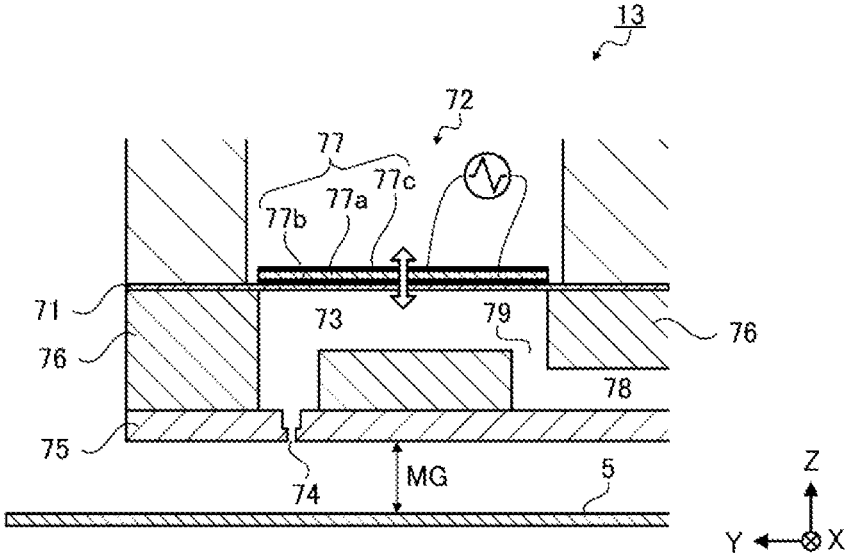
FIG. 7 is a cross-sectional view of a main part of a printing head.

FIG. 7 is a cross-sectional view of a main part of a printing head 13.

The printing head 13 includes the nozzles 74 through which the ink is discharged and the pressure generating units 72 provided in association with the respective nozzles 74.

Each of the pressure generating units 72 includes a cavity 73 serving as a pressure generation chamber, a vibrating plate 71, and an actuator 77.

The cavity 73 is in communication with the nozzle 74 and is filled with the ink.

The vibrating plate 71 constitutes at least a part of a surface constituting the cavity 73 (in the example in illustrated in FIG. 7, the vibrating plate 71 constitutes a top surface of the cavity 73). Displacement (deflection) of the vibrating plate 71 increases or reduces the volume of the cavity 73 (in other words, an internal pressure in the cavity 73).

The actuator 77 includes a piezoelectric thin film 77*a* (piezo element), an electrode 77*b* provided to cover one of a front surface and a back surface of the piezoelectric thin film 77*a*, and an electrode 77*c* provided to cover the other of the front and back surfaces of the piezoelectric thin film 77*a*. The actuator 77 is laminated onto the vibrating plate 71 to sandwich the vibrating plate 71 between the actuator 77 and the cavity 73. A voltage is applied between the electrode 77*b* and the electrode 77*c* to deform the piezoelectric thin film 77*a* (piezo element), thus allowing the vibrating plate 71 to be deflected (deflected and vibrated).

The nozzles 74 are formed in a nozzle plate 75. Furthermore, the cavity 73 and reservoirs 78 each in communication with a corresponding one of the cavity 73 via an ink supplying port 79 are formed in a cavity substrate 76 positioned to lie between the nozzle plate 75 and the vibrating plate 71. Each of the reservoirs 78 is in communication with an ink tank (not illustrated) via the ink supply path.

In the pressure generating unit 72 configured as described above, the drive signal (drive signal COM) changing a voltage level (potential) between the electrodes 77*b* and 77*c* is applied to deflect and vibrate the vibrating plate 71 as illustrated by an arrow in FIG. 7. This changes pressure inside the cavity 73 and allows the ink inside the cavity 73 to be vibrated or allows ink droplets to be discharged through the nozzle 74.

Driving Control of Printing Head

Figure 8:
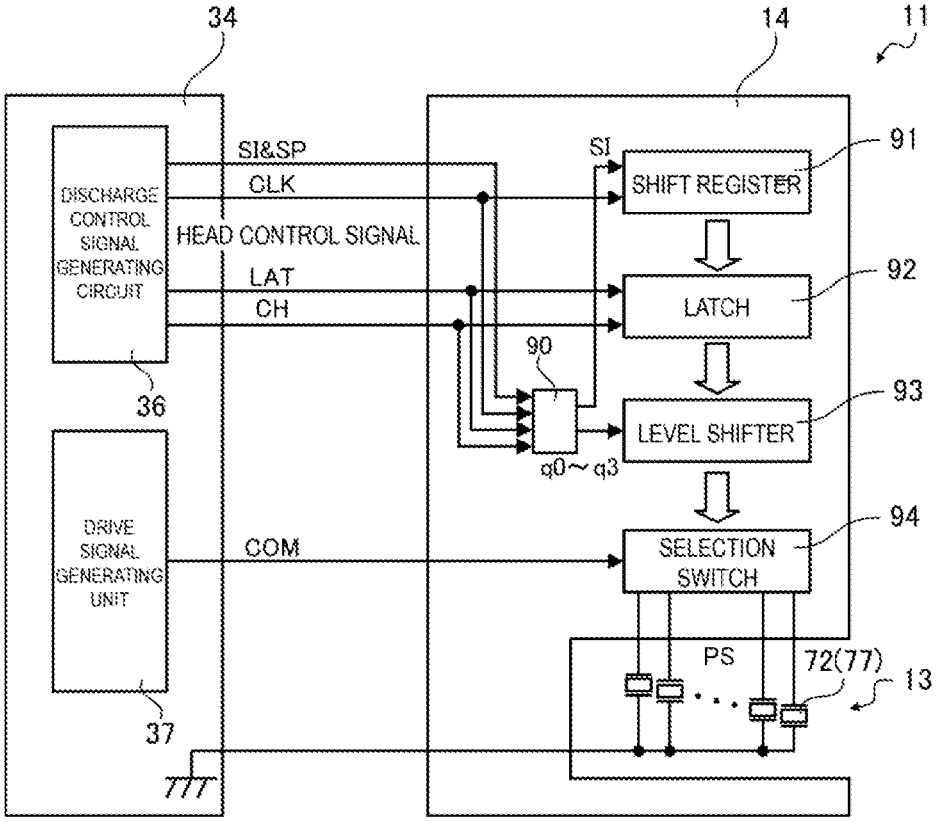
FIG. 8 is a block diagram illustrating an example of a configuration of a drive control system driving the printing head.

Driving control of the printing head 13 will now be described with reference to FIG. 8. FIG. 8 is a block diagram illustrating an example of a configuration of a drive control system driving the printing head 13.

As described above, the head unit 11 includes the printing head 13 and the head controller 14. Furthermore, the drive controller 34 includes the discharge control signal generating circuit 36 and the drive signal generating circuit 37 to controllably drive the printing head 13 via the head controller 14.

More specifically, the drive controller 34 selectively drives, via the head controller 14, the pressure generating unit 72 (actuator 77) corresponding to each of the nozzles 74, based on head control signals generated by the discharge control signal generating circuit 36 and the drive signal COM generated by the drive signal generating circuit 37.

The drive signal COM is a basic drive signal causing the head controller 14 to drive the actuator 77 by application of the voltage while changing the level of the voltage, thus fluctuating the pressure on the ink in the cavity 73 to discharge the ink through the nozzle 74. That is, the level of the drive signal COM (in this case, an applied voltage level) is changed and the resultant signal is applied to the actuator 77 to enable a desired amount of ink to be discharged through the nozzle 74.

Examples of the head control signals include drive pulse selection data SI&SP, a clock signal CLK, a latch signal LAT, and a channel signal CH.

The drive pulse selection data SI&SP includes pixel data SI designating the actuator 77 corresponding to the nozzle 74 through which ink droplets are to be discharged and waveform pattern data SP of the drive signal COM relating to the amount of ink discharged.

The latch signal LAT and the channel signal CH are control signals defining timing for the drive signal COM.

The latch signal LAT causes output of a series of drive signals COM to be started. A drive pulse PS is output for each channel signal CH.

Driving of Ink Discharge

Driving for causing the ink to be discharged will now be described.

As illustrated in FIG. 8, the head controller 14 includes a control circuit 90, a shift register 91, a latch circuit 92, a level shifter 93, and a selection switch 94.

The head controller 14 uses the control circuit 90 to generate waveform selection signals q0 to q3 (see FIG. 9) from the head control signal received from the drive controller 34 (discharge control signal generating circuit 36). The waveform selection signals q0 to q3 are generated based on the waveform pattern data SP and timing signals such as the clock signal CLK, the latch signal LAT, and the channel signal CH. Description of steps of generating the waveform selection signals q0 to q3 is omitted.

The pixel data SI is sequentially input to the shift register 91, and each storage region shifts, starting with the first storage region, to a succeeding storage region in response to an input pulse of the clock signal CLK. Once an amount of pixel data SI corresponding to the number of nozzles is stored in the shift register 91, the latch circuit 92 uses the input latch signal LAT to latch each output signal from the shift register 91. The signal saved in the latch circuit 92 is converted, by the level shifter 93, into a voltage level at which the succeeding selection switch 94 can be turned on or off (connection/shutdown). When an output from the level shifter 93 turns on the selection switch 94, the drive signal COM is connected to the actuator 77. That is, the drive pulse PS is applied to the actuator 77.

Figure 9:
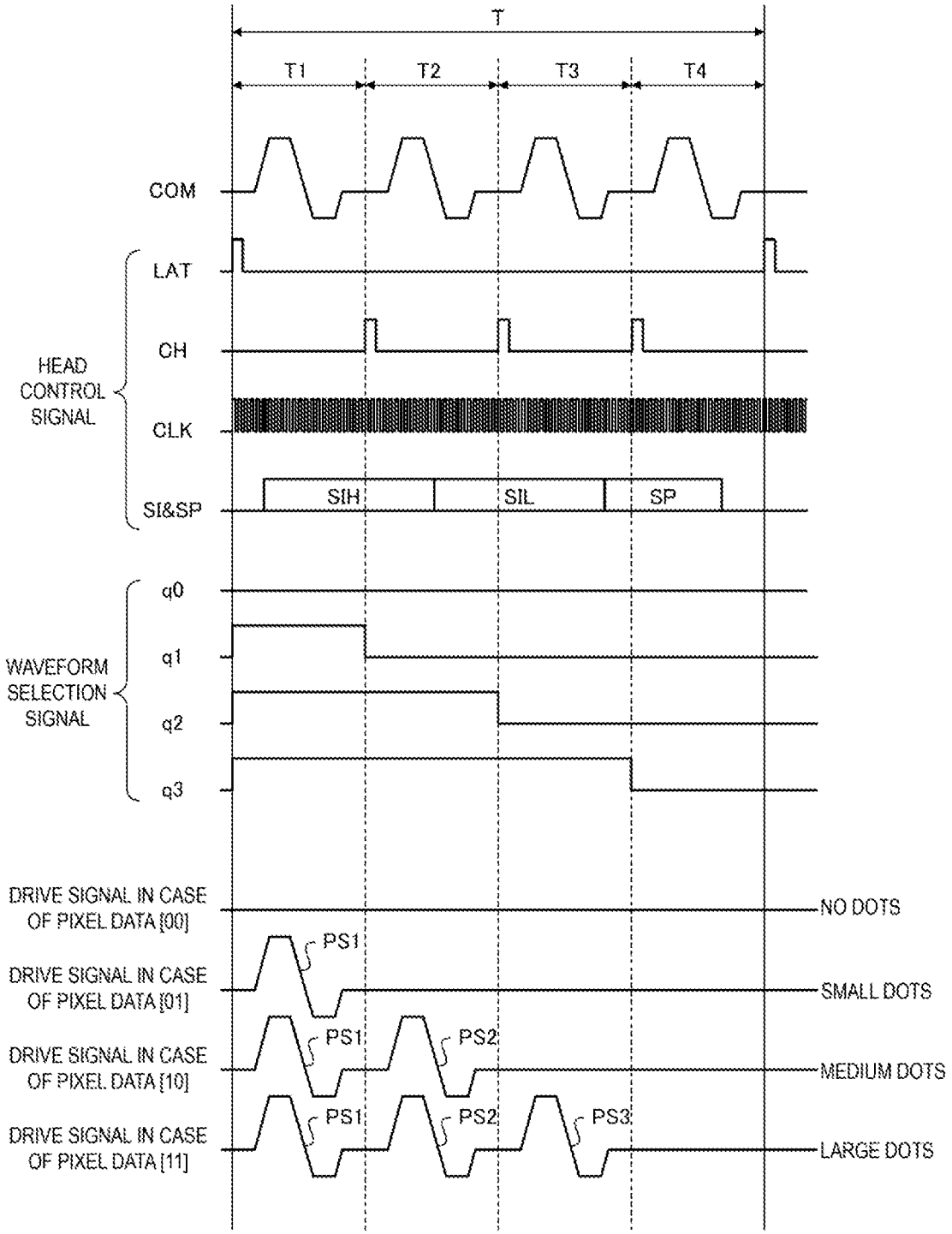
FIG. 9 is a timing chart illustrating drive signals causing ink to be discharged.

FIG. 9 is a timing chart illustrating drive signals causing ink to be discharged. Drive pulses PS1 to PS3 illustrated in FIG. 9 correspond to drive signals (drive waveforms) applied to the actuator 77 and indicate signals causing ink droplets to be discharged (signals based on the drive signal COM). Furthermore, in FIG. 9, a period T (also referred to as a cycle T) that is a cycle period corresponds to a period when the nozzle 74 moves a distance corresponding to one pixel in the main scanning direction. For example, for a printing resolution of 720 dpi, the period T corresponds to a period when the nozzle 74 moves 1/720 inches with respect to the printing medium 5.

The head controller 14 applies, to the actuator 77, signals (drive pulses PS1 to PS3) from the drive signal COM for causing the ink to be selectively discharged, in accordance with the drive pulse selection data SI&SP and the waveform selection signals q0 to q3. That is, the drive signal COM (drive pulses PS1 to PS3) is selectively applied in accordance with the waveform selection signals q0 to q3, to discharge ink droplets with different sizes into one pixel to express multiple gray scales.

Specifically, as illustrated in FIG. 9, when a large dot is to be formed (2-bit image data (dot gray scale value) is [11]), the waveform selection signal q3 causes, during a period T1 to a period T3, the corresponding drive signal COM (that is, the drive pulse PS1, the drive pulse PS2, and the drive pulse PS3) to be selected and applied to the actuator 77 (piezoelectric thin film 77*a*).

When a medium dot is to be formed (the dot gray scale value is [10]), the waveform selection signal q2 causes, during the period T1 to the period T2, the corresponding drive signal COM (that is, the drive pulse PS1 and the drive pulse PS2) to be selected and applied to the actuator 77.

When a small dot is to be formed (the dot gray scale value is [01]), the waveform selection signal q1 causes, during the period T1, the corresponding drive signal COM (that is, the drive pulse PS1) to be selected and be applied to the actuator 77.

When no dot is to be formed (the dot gray scale value is [00]), the waveform selection signal q0 prevents, during the periods T, selection of the drive signal COM. Therefore, no signal for causing the ink to be discharged is applied to the actuator 77.

The drive signal COM (drive pulses PS1 to PS3) is formed of a waveform including a trapezoidal wave. The drive signal COM (drive pulses PS1 to PS3) needs to accurately control timing to discharge ink droplets and the amount of ink discharged during a single discharging operation. The drive signal COM is thus formed of a trapezoidal wave, in other words, a waveform allowing a corresponding output value to be varied over time.

According to the known printing (recording) based on the above-described basic configuration, when the main scanning is executed with discharge of ink droplets at a high nozzle duty, the droplets may be simultaneously discharged through many neighboring nozzles 74 or discharge of ink droplets may occur with a short discharge period, possibly leading to non-negligible airflows (air turbulence) on a printing surface of the printing medium 5. The airflows may affect flying trajectories of satellite droplets with a small mass resulting from the discharge of ink droplets, possibly leading to wind ripples on the printing medium 5.

Thus, the printing system 1 according to Exemplary Embodiment 1, the printing controller 111 controls recording under conditions that, for pixel data of the image data having a "prescribed gray scale value" (prescribed input gray scale value) or larger, a nozzle duty corresponding to the number of nozzles 74 capable of discharging ink droplets per unit area on the printing medium 5 is smaller than or equal to a set upper limit value and that the discharge amount of ink droplets discharged per unit area is variable.

Furthermore, a printing method as a "recording method" according to Exemplary Embodiment 1 involves executing recording under conditions that, for pixel data of the recording image (image data) that have a prescribed gray scale value or larger, the nozzle duty corresponding to the number of nozzles 74 capable of discharging ink droplets per unit area on the printing medium 5 is smaller than or equal to a set upper limit value and that the discharge amount of the droplets discharged per the unit area is variable.

Details will be described below.

Figure 10:
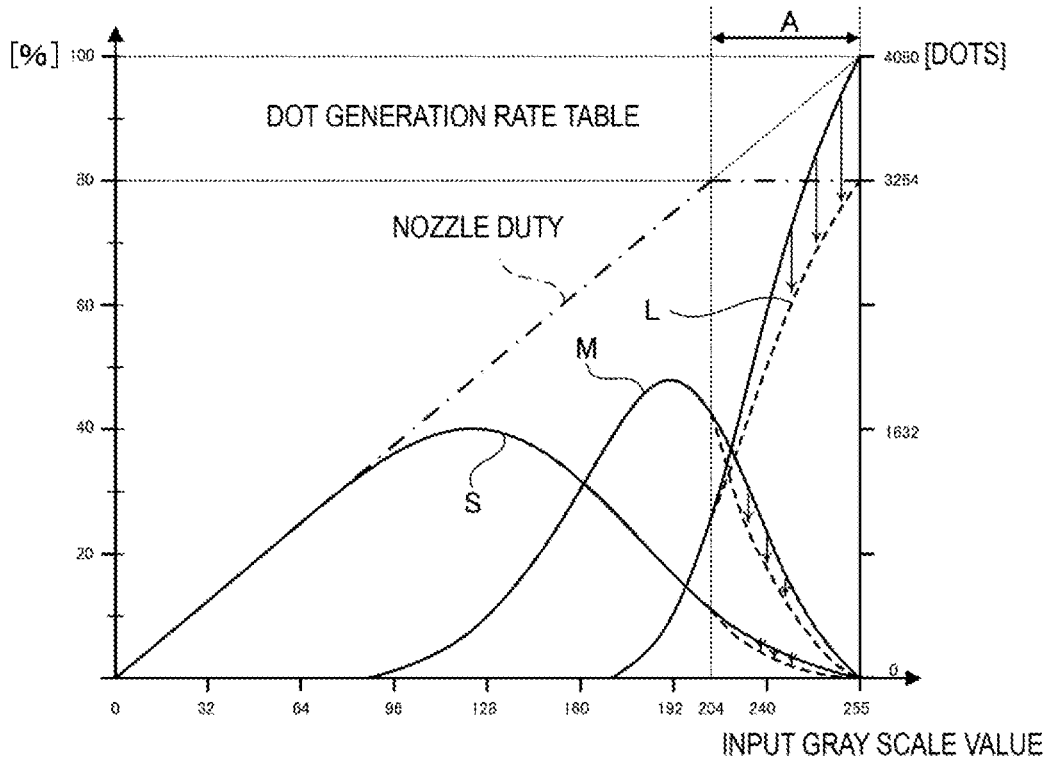
FIG. 10 is a graph illustrating a dot generation rate table for use in halftone processing according Exemplary Embodiment 1.

FIG. 10 is a graph illustrating a dot generation rate table for use in halftone processing in the printing system 1 according Exemplary Embodiment 1 compared to the dot generation rate table according to related art described with reference to FIG. 5.

Exemplary Embodiment 1 is intended to suppress possible wind ripples. Thus, for pixel data of the image data having a "prescribed gray scale value" or larger, an upper limit is set for the nozzle duty corresponding to the number of nozzles 74 capable of discharging ink droplets per unit area on the printing medium 5.

For example, as illustrated in FIG. 10, for pixel data having an input gray scale value of 204 or larger, the nozzle duty (the number of nozzles 74 capable of discharging ink droplets per unit area) is 80% (3264 nozzles) or less. In FIG. 10, graphs illustrated by solid lines indicate the dot generation rate (the number of generated dots) of dots for each dot size according to the related art. In an area A with an input gray scale value of 204 or larger, graphs corrected in the directions of arrows and illustrated by dashed lines indicate the dot generation rate (the number of generated dots) of dots for each dot size according to Exemplary Embodiment 1.

Here, the input gray scale value 204 is a threshold of the input gray scale value to which the upper limit value of the nozzle duty is applied and is a "prescribed gray scale value" of the image data. Furthermore, the "upper limit value" of the nozzle duty is the number of nozzles 74 capable of discharging ink droplets per unit area, i.e., 3264.

Furthermore, in the area A with an input gray scale value of 204 or larger, while the nozzle duty is smaller than or equal to the upper limit value, the discharge amount of ink droplets discharged per unit area is variable, thus enabling gray scale expression. Specifically, the size of each ink droplet increases consistently with input gray scale value of the image data.

Furthermore, the total of the dot generation rates (the number of generated dots) of dots with the respective dot sizes is constant at the upper limit value of 80% (3264 dots) in the area A with an input gray scale value of 204 or larger. In other words, a graph illustrated by an alternate long and short dash line in FIG. 10 indicates the number of nozzles 74 corresponding to the input gray scale value (the number of nozzles 74 capable of discharging ink droplets per unit area).

In the area A with an input gray scale value of 204 or larger, wind ripples are suppressed when the nozzle duty is smaller than or equal to the upper limit value. However, the upper limit value is set constant at 80% (3264 dots) in order to allow the gray scales to be more appropriately printed. For the input gray scale value of 204 or larger, the number of nozzles 74 through which ink droplets are discharged is constant, and the size of each ink droplet increases consistently with input gray scale value of the image data. An increased size of ink droplets means an increase in the rate of ink droplets with a large size.

Thus, in Exemplary Embodiment 1, the dot generation rate table is provided in which, for the pixel data having the "prescribed gray scale value" or larger, the upper limit is set for the nozzle duty to allow the gray scales to be expressed with the nozzle duty at the upper limit. The image processor 110 (printing controller 111) uses the dot generation rate table to execute halftone processing, and generates printing data based on results of the halftone processing. The image processor 110 then causes the printer 100 to execute printing using the printing data.

That is, the image processor 110 (printing controller 111) controls printing under a condition that, for the pixel data having the prescribed gray scale value or larger, the nozzle duty is constant. The image processor 110 (printing controller 111) also controls the printing under a condition that, for the pixel data having the prescribed gray scale value or larger, the size of each ink droplet is increased in accordance with an increase in the input gray scale value of the image data.

Note that, desirably, the "prescribed gray scale value," corresponding to the threshold of the input gray scale value at which the nozzle duty is at the upper limit, and the upper limit value of the nozzle duty are predetermined during a manufacturing process for the printing system 1 with degradation of printing quality caused by possible wind ripples sufficiently evaluated, and the prescribed gray scale value and the upper limit value are then incorporated in the dot generation rate table (stored in the memory 33 in the printer 100).

As described above, according to the recording device and the recording method according to Exemplary Embodiment 1, the effects below can be achieved.

For the pixel data of the image data having the prescribed gray scale value or larger, the nozzle duty corresponding to the number of nozzles 74 capable of discharging ink droplets per unit area on the printing medium 5 is smaller than or equal to the upper limit value. This enables a reduction in the intensity of airflows occurring on the printing surface of the printing medium 5 under the effect of discharge of ink droplets. As a result, possible wind ripples and the like are suppressed, thus allowing printing quality to be improved.

Furthermore, printing images with input gray scale values smaller than the prescribed gray scale value (that is, input gray scale values including a range of input gray scale values corresponding to a low density or frequency of discharge of ink droplets and thus to a low intensity of airflows occurring under the effect of discharge, leading to no likelihood of wind ripples) are not intended for control in which the nozzle duty is set smaller than or equal to the upper limit value. This prevents the printing images from being degraded. In other words, according to Exemplary Embodiment 1, the control for suppressing possible wind ripples is executed on the input gray scale values within the range likely to involve the wind ripples, thus allowing possible degradation of printing quality to be suppressed.

Furthermore, for the pixel data of the image data having the prescribed gray scale value or larger, the discharge amount of ink droplets discharged per unit area is variable in conjunction with the nozzle duty smaller than or equal to the upper limit value. This allows the gray scales of the image data to be expressed even though the number of nozzles 74 capable of discharging ink droplets is limited to suppress possible wind ripples and the like.

Furthermore, for the pixel data of the image data having the prescribed gray scale value or larger, the nozzle duty is constant at the upper limit value or smaller. This enables a variation in the intensity of airflows occurring under the effect of discharge of ink droplets to be limited to a given range.

Furthermore, printing is controlled under condition that, for the pixel data of the image data having the prescribed gray scale value or larger, the size of each ink droplet is increased in accordance with an increase in an input gray scale value of the image data, with the nozzle duty kept smaller than or equal to the upper limit value. This allows the gray scales of the image data to be expressed in accordance with the input gray scale value of the image data even though the number of nozzles 74 capable of discharging ink droplets is limited to suppress possible wind ripples and the like.

Note that the invention of this application is not limited to Exemplary Embodiment 1 described above, and Exemplary Embodiment 1 described above can be variously changed and modified. Hereinafter modified examples are described. Note that the same constituents as those in Exemplary Embodiment 1 are given the same reference signs, and redundant description of these constituents will be omitted.

MODIFIED EXAMPLE 1

A printing system 1*a* (not illustrated) serving as a "recording device" according to Modified Example 1 includes, in addition to the components of the printing system 1, a gap adjusting unit 60 capable of changing a distance between the printing head 13 and the printing medium 5 (hereinafter referred to as a media gap MG), and a gap control circuit 38. The printing controller 111 changes the "prescribed gray scale value" and the "upper limit value" according to the size of the media gap MG to control recording (printing). Specifically, the media gap MG is a distance from a tip of each of the nozzles 74 to the printing surface of the printing medium 5 (see FIG. 7 and FIG. 11). Details will be described below.

Figure 11:
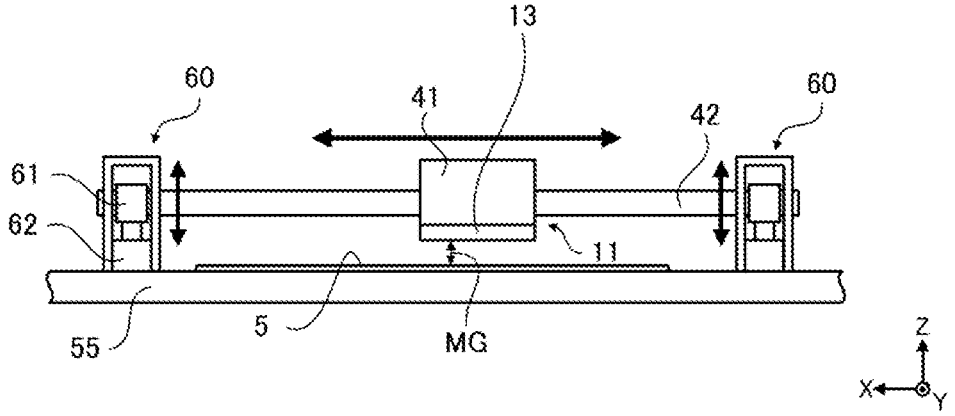
FIG. 11 is a conceptual view illustrating a configuration of a gap adjusting unit provided in a recording device according to Modified Example 1.

FIG. 11 is a conceptual view illustrating a configuration of the gap adjusting unit 60 provided in the printing system 1*a*.

The gap adjusting unit 60 includes a guide shaft support unit 61 configured to support both end portions of the guide shaft 42 extending in the main scanning direction, a guide shaft elevator unit 62 that is fixed to the upper surface of the platen 55 on an outer side of a printing region and is configured to movably support the guide shaft support unit 61 in an up-down direction (Z-axis direction).

The gap control circuit 38 is a control circuit configured to generate a signal controlling driving of the gap adjusting unit 60, and is provided in the drive controller 34 (the gap control circuit 38 is not illustrated).

The guide shaft elevator unit 62 includes a drive motor (not illustrated) controlled by a signal from the gap control circuit 38, and can move the guide shaft support unit 61 in the up-down direction (Z-axis direction) by the driving of the drive motor.

The media gap MG is adjusted to a preset appropriate size (the appropriate distance from the tip of each nozzle 74 to the printing surface of the printing medium 5) by, for example, inputting, for printing, the type of the printing medium 5 (for example, an item number of the printing medium 5) and thickness information about the printing medium 5 through the input unit 112 (see FIG. 2). For example, in a case where specifications include a material quality or a thickness that makes the printing medium 5 susceptible to floating upward from a support surface of the platen 55, the medium gap MG needs to be set to a larger value to avoid rubbing against the printing head 13. On the other hand, a larger value of the media gap MG increases a duration of exposure of flying ink droplets to airflows, thus making the flying trajectories of satellite ink droplets with a smaller size more susceptible to the airflows. Thus, the printing controller 111 changes the "prescribed gray scale value" and the "upper limit value" according to the size of the media gap MG to reduce the intensity of airflows occurring under the effect of discharge of ink droplets.

Specifically, multiple dot generation rate tables are prepared in association with multiple media gaps MG preset according to the type of the printing medium 5 to be processed by the printing system 1*a*. The dot generation rate tables are stored in the memory 33 in the printer 100.

Each of the dot generation rate tables includes the "prescribed gray scale value" and the "upper limit value" set based on results of sufficient preliminary evaluation of printing quality for each size of the media gap MG.

For printing, the type of the printing medium 5 (the item number of the printing medium 5 and the thickness information about the printing medium 5) is specified through the input unit 112 to select the corresponding dot generation rate table.

According to Modified Example 1, the prescribed gray scale value corresponding to the threshold to which the upper limit value of the nozzle duty is applied and the upper limit value of the nozzle duty are changed according to the distance between the printing head 13 and the printing medium 5 (the size of the media gap MG) to reduce, according to the more appropriate condition, the intensity of airflows occurring under the effect of discharge of ink droplets. In particular, in a case where a cloth is used as the printing medium 5, the distance between the printing medium 5 and the printing head 13 is increased to avoid contact between fluff on a surface of the cloth and the printing head 13, resulting in a high likelihood of wind ripples. Thus, the invention can be effectively utilized for this case.

Note that a method for changing the "prescribed gray scale value" and the "upper limit value" according to the size of the media gap MG is not limited to the method of selecting one of the prepared multiple dot generation rate tables that corresponds to the media gap MG. For example, a possible method may include preparing in advance a function associating the media gap MG with the "prescribed gray scale value" and the "upper limit value," using the function to derive the corresponding "prescribed gray scale value" and "upper limit value," and generating, for use, a dot generation rate table based on the derived "prescribed gray scale value" and "upper limit value."

MODIFIED EXAMPLE 2

In Exemplary Embodiment 1 described above, it is described that, desirably, the "prescribed gray scale value," corresponding to the threshold of the input gray scale value at which the nozzle duty is at the upper limit, and the upper limit value of the nozzle duty are predetermined during the manufacturing process for the printing system 1 with degradation of printing quality caused by possible wind ripples sufficiently evaluated, and the prescribed gray scale value and the upper limit value are then incorporated in the dot generation rate table (stored in the memory 33 in the printer 100). However, a printing system may be configured to correct the set "prescribed gray scale value" and the "upper limit value" of the nozzle duty during a use phase of the printing system 1.

A printing system 1*b* according to Modified Example 2 (not illustrated) corresponds to the printing system 1 according to Exemplary Embodiment 1, and further includes an "input unit" configured to input an upper limit value change instruction. The printing controller 111 is configured to change the upper limit value and the prescribed gray scale value, based on the upper limit value change instruction received from the input unit, to control recording.

Specifically, for printing, the printing controller 111 is configured to refer to the dot generation rate table stored in the memory 33 for the preset "upper limit value" of the nozzle duty to display the "upper limit value" on the display unit 113 (see FIG. 2). The printing controller 111 allows a user of the printing system 1*b*, having viewed the displayed value, to directly input a corrected value (new upper limit value) through the input unit 112 serving as the "input unit," to accept the correction of the "upper limit value."

For example, in a case where printing is executed using more pass operations, the nozzle duty during each pass naturally has a small value, thus reducing the intensity of non-negligible airflows (air turbulence) occurring on the printing surface of the printing medium 5 as a result of simultaneous discharge of ink droplets through many neighboring nozzles 74 or discharge of ink droplets with a short discharge period. In such a case, that is, in a case where, for example, a printing mode with an increased number of pass operations is set by the user, the "upper limit value" of the nozzle duty in the dot generation rate table for use in the phase of the halftone processing can be set to a larger value (the upper limit value can be increased).

Figure 12:
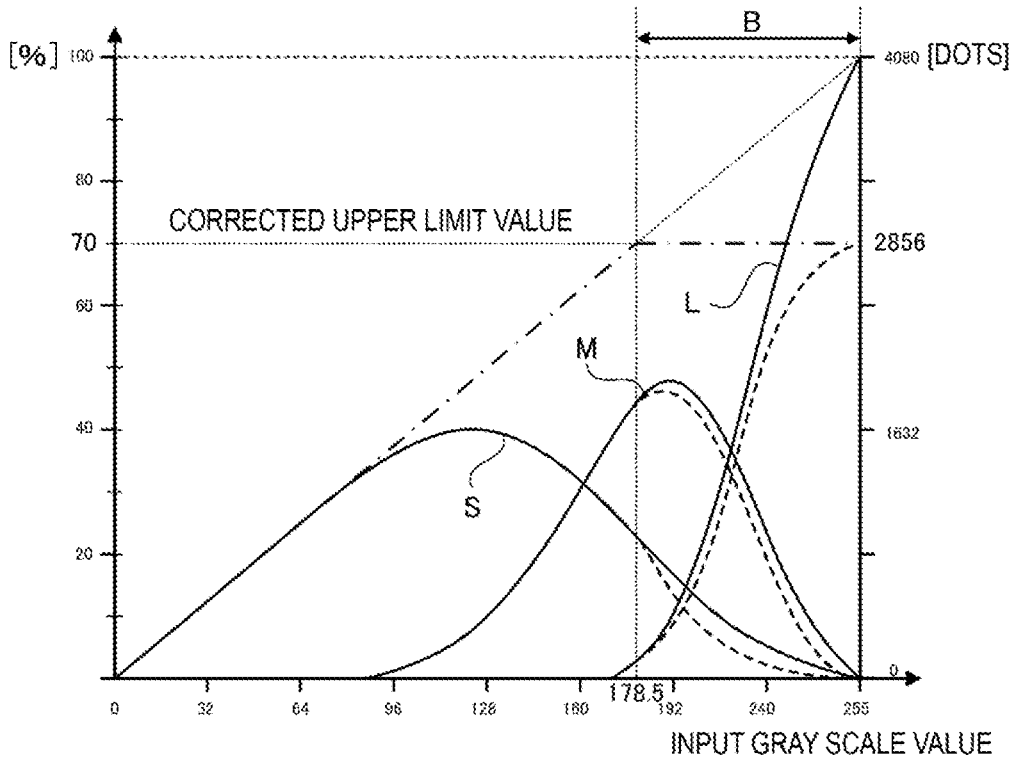
FIG. 12 is a graph illustrating the dot generation rate table in a case where a corrected upper limit value is accepted.

FIG. 12 is a graph illustrating the dot generation rate table in which the nozzle duty illustrated in FIG. 10 has an upper limit value of 80% (3264 dots) in a case where a new upper limit value (corrected upper limit value) of 70% (2856 dots)

is accepted. Compared to graphs for the dot generation rate table (the dot generation rate table in related art) illustrated by solid lines and involving no upper limit of the nozzle duty, graphs in which the nozzle duty has an upper limit of 70% (2856 dots) as a result of correction of the dot generation rate (the number of generated dots) of dots for each dot size are illustrated by dashed lines.

The printing controller 111 derives, from the accepted new upper limit value (corrected upper limit value), the "prescribed gray scale value," corresponding to the threshold of the input gray scale value to which the upper limit value is applied. The "prescribed input gray scale value," corresponding to the threshold of the input gray scale value to which the upper limit value of the nozzle duty is applied, can be derived from the input gray scale value and the total dot generation rate (total number of generated dots), which are in a linear relationship. For example, in the example illustrated in FIG. 12, the "prescribed gray scale value" is an input gray scale value of 178.5 corresponding to an upper limit value (corrected upper limit value) of 70% (2856 dots). In other words, in an area B with an input gray scale value of 178.5 or larger, the dot generation rates (the number of generated dots) of dots with the respective dot sizes including the small dot (S), the medium dot (M), and the large dot (L) are corrected to acquire an upper limit value (corrected upper limit value) of 70% (2856 dots).

Note that a ratio (sharing ratio) of correction of the dot generation rates (the number of generated dots) of dots with the respective dot sizes including the small dot (S), the medium dot (M), and the large dot (L) is not specified but is desirably set as a function between the ratio and the upper limit value (corrected upper limit value) with printing quality preliminarily sufficiently evaluated.

According to Modified Example 2, the system includes the input unit 112 for inputting the upper limit value of the nozzle duty, and the printing controller 111 changes the prescribed gray scale value, based on the upper limit value received from the input unit 112 and controls printing, based on the input upper limit value and the changed gray scale value. This allows more appropriate adjustment of the condition for reducing the intensity of airflows occurring under the effect of discharge of ink droplets.

The upper limit value change instruction may be given by inputting the corrected upper limit value as described above or pressing a button such as "wind ripple suppression" to set a prescribed upper limit value at which possible wind ripples can be suppressed.

MODIFIED EXAMPLE 3

In Exemplary Embodiment 1, it is described that the printer 100 provided in the printing system 1 serving as the "recording device" is a serial printer. However, the printer 100 may be a line printer.

Figure 13:
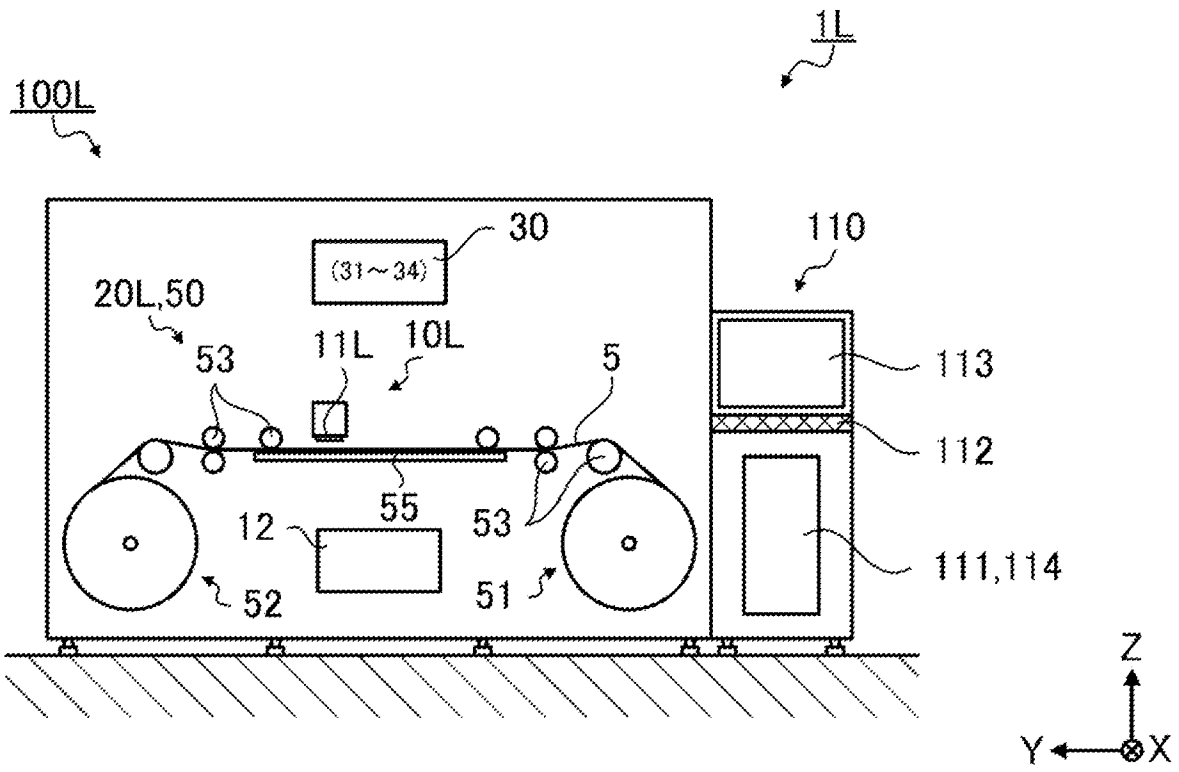
FIG. 13 is a front view illustrating a configuration of a recording device according to Modified Example 3.
Figure 14:
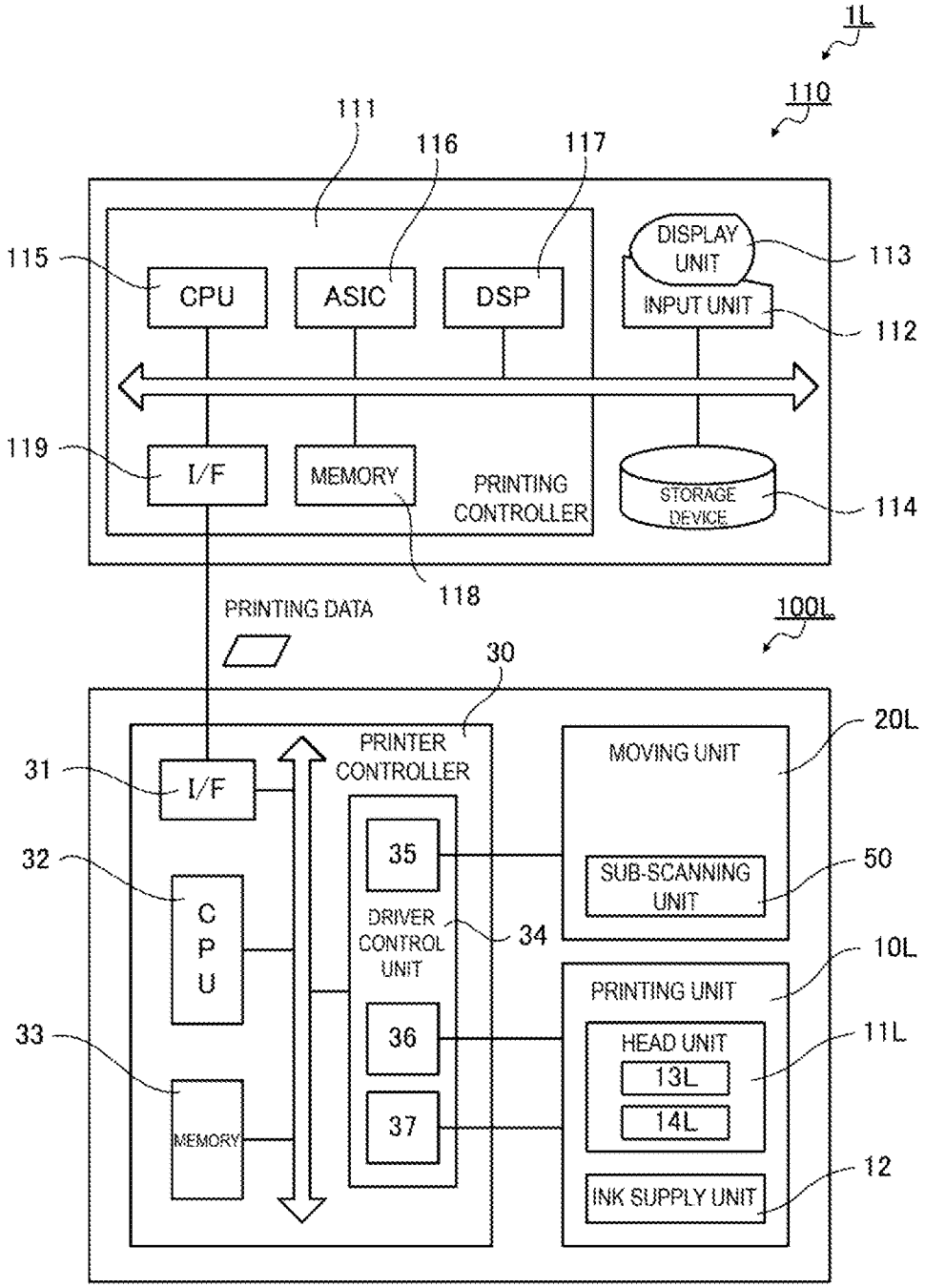
FIG. 14 is a block diagram illustrating the configuration of the recording device according to Modified Example 3.

FIG. 13 is a front view illustrating a configuration of a printing system 1L according to Modified Example 3, and FIG. 14 is a block diagram of the configuration.

The printing system 1L includes a printer 100L instead of the printer 100 in Exemplary Embodiment 1. The printer 100L is an ink jet-type line printer that prints a desired image on the printing medium 5, which is a long-length "printing medium" supplied in a roll shape, based on printing data received from the image processor 110.

Basic Configuration of Printer 100L

The printer 100L includes a printing unit 10L, a moving unit 20L, and the printer controller 30. The printer 100L that has received the printing data from the image processor 110, is configured to control the printing unit 10L and the moving unit 20L by the printer controller 30 to print (form) an image on the printing medium 5.

The printing unit 10L includes a head unit 11L and the ink supply unit 12.

The moving unit 20L includes the sub-scanning unit 50.

The head unit 11L includes a printing head 13L serving as a "recording head" and including multiple nozzles (nozzle rows) for discharging ink as ink droplets, and a head controller 14L.

Figure 15:
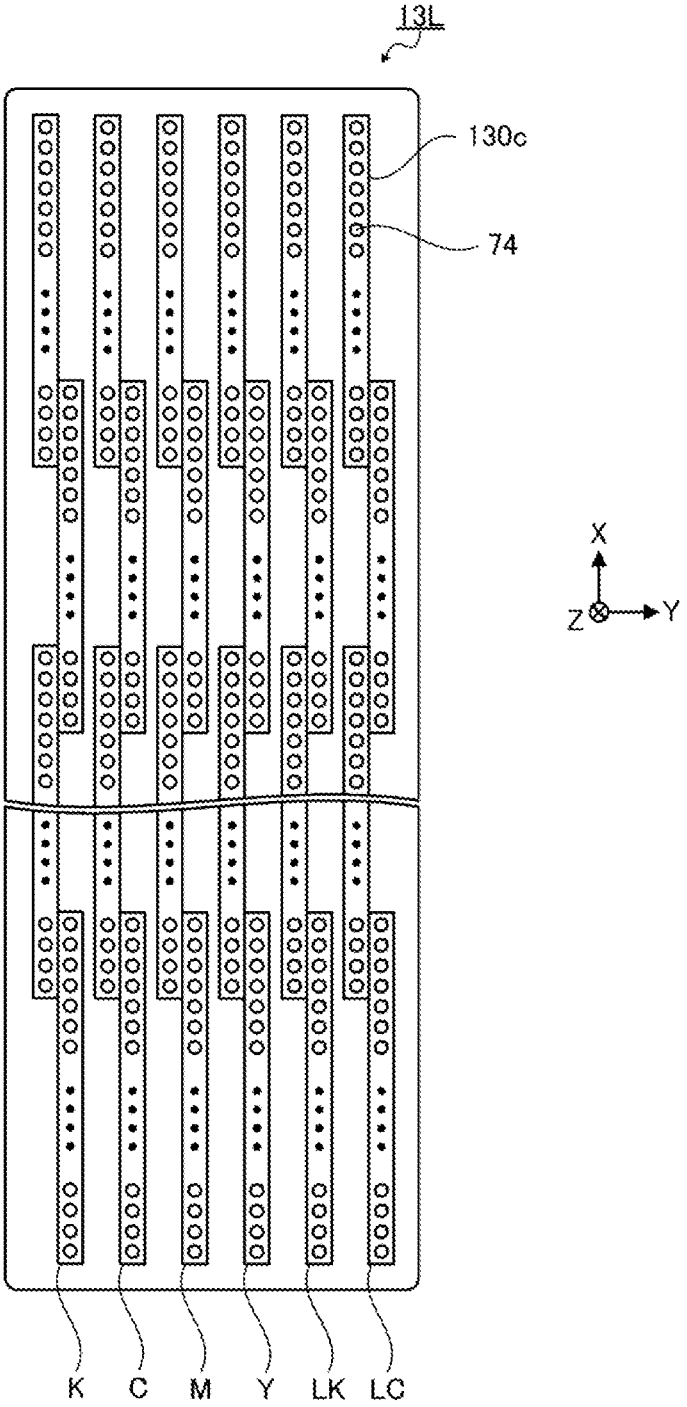
FIG. 15 is a schematic diagram illustrating an example of an array of nozzles in a printing head provided in the recording device according to Modified Example 3.

FIG. 15 is a schematic diagram illustrating an example of arrangement of the nozzles when viewed from a lower surface of the printing head 13L.

As illustrated in FIG. 15, the printing head 13L is a so-called line head and includes six nozzle rows each including multiple nozzle tips 130*c* each including multiple nozzles 74, the nozzle rows being configured such that the same ink is discharged from each line, the nozzle rows each being arranged to have a length larger than a maximum width of the printing medium 5 in the width direction (X-axis direction) of the printing medium 5 intersecting with the conveying direction (Y-axis direction) of the printing medium 5 (the black ink nozzle row K, the cyan ink nozzle row C, the magenta ink nozzle row M, the yellow ink nozzle row Y, a gray ink nozzle row LK, and a light cyan ink nozzle row LC).

Furthermore, the nozzle tips 130*c* are provided such that four nozzles 74 at an end portion of each nozzle tip 130*c* overlap four nozzles 74 at a corresponding end portion of an adjacent nozzle tip 130*c* in the Y-axis direction.

The head controller 14L is controlled by the printer controller 30 based on the printing data, to drive the printing head 13L. Description of a configuration of the head controller 14L is omitted.

Printing data is generated by the rasterization processing (that is, processing involving no pass allocation described in Exemplary Embodiment 1) in which the pixel data generated based on the image data and arranged in a matrix as a result of the halftone processing is expanded into the nozzle rows of the printing head 13L.

Even in the printing system 1L configured as described above, in other words, even in a recording device including a line printer such as the printer 100L, ink droplets may be simultaneously discharged through many neighboring nozzles 74 or discharge of ink droplets may occur with a short discharge period, possibly leading to non-negligible airflows (air turbulence) on a printing surface of the printing medium 5. The airflows may affect the flying trajectories of satellite droplets with a small mass resulting from the discharge of ink droplets, leading to wind ripples on the printing medium 5.

Thus, in the printing system 1L, the printing controller 111 controls recording under conditions that, for pixel data of the image data having a prescribed gray scale value or larger, the nozzle duty corresponding to the number of nozzles 74 capable of discharging ink droplets per unit area on the printing medium 5 is smaller than or equal to a set upper limit value and that the discharge amount of ink droplets discharged per unit area is variable, as is the case with Exemplary Embodiment 1.

In other words, even the printing system 1L including the line printer illustrated in Modified Example 3 can produce the following effect by preparing the dot generation rate table for use in the halftone processing as is the case with Exemplary Embodiment 1. When printing is controlled for pixel data of the recording image that have a prescribed gray scale value or larger under conditions that the nozzle duty corresponding to the number of nozzles 74 capable of discharging ink droplets per unit area on the printing medium 5 is smaller than or equal to the upper limit value and that the discharge amount of the droplets discharged per unit area is variable, the gray scales of recording images can be expressed even though possible wind ripples and the like are suppressed.

Contents derived from the exemplary embodiments will be described below.

An aspect of the application provides a recording device including a recording head with multiple nozzles arranged therein to discharge droplets onto a recording medium, and a recording controller configured to control recording of a recording image, the recording including moving the recording head relative to the recording medium while the droplets are discharged, wherein the recording controller is configured to control the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable.

According to this configuration, for the pixel data of the recording image having the prescribed gray scale value or larger, the nozzle duty corresponding to the number of nozzles included in the multiple nozzles and being able to discharge the droplets per unit area on the recording medium, is smaller than or equal to the upper limit value. This enables a reduction in the intensity of airflows occurring on a recording surface of the recording medium under the effect of discharge of droplets. As a result, possible wind ripples and the like are suppressed, thus allowing recording quality to be improved.

Furthermore, recording images with gray scale values smaller than the prescribed gray scale value (that is, gray scale values including a range of gray scale values corresponding to a low density or frequency of discharge of droplets and thus to a low intensity of airflows occurring under the effect of discharge, leading to no likelihood of wind ripples) are not intended for control in which the nozzle duty is set smaller than or equal to the upper limit value. This prevents the recording images from being degraded. In other words, the control for suppressing possible wind ripples is executed on the gray scale values within the range likely to involve the wind ripples, thus allowing possible degradation of recording quality to be suppressed.

Furthermore, for the pixel data of the recording image having the prescribed gray scale value or larger, the discharge amount of droplets discharged per unit area is variable in conjunction with the nozzle duty smaller than or equal to the upper limit value. This allows the gray scales of the recording image to be expressed even though the number of nozzles capable of discharging droplets is limited to suppress possible wind ripples and the like.

In the recording device, the recording controller is preferably configured to control the recording on condition that, for the pixel data having the prescribed gray scale value or larger, the nozzle duty is constant.

According to this configuration, for the pixel data of the recording image having the prescribed gray scale value or larger, the nozzle duty is constant at the upper limit value or smaller. This enables a variation in the intensity of airflows occurring under the effect of discharge of droplets to be limited to a given range.

In the recording device, the recording controller is preferably configured to control the recording on condition that, for the pixel data having the prescribed gray scale value or larger, a size of each of the droplets is increased in accordance with an increase in a gray scale value of the recording image.

According to this configuration, the recording is controlled according to the condition that, for the pixel data of the recoding image having the prescribed gray scale value or larger, the size of each droplet is increased in accordance with an increase in a gray scale value of the recording image, with the nozzle duty kept smaller than or equal to the upper limit value. This allows the gray scales of the recoding image to be expressed in accordance with the gray scale values of the recording image even though the number of nozzles being able to discharge droplets is limited to suppress possible wind ripples and the like.

In the recording device, the recording controller is preferably configured to change the prescribed gray scale value and the upper limit value, depending on a distance between the recording head and the recording medium, to control the recording.

According to this configuration, a longer distance between the recording head and the recording medium tends to cause airflows to more significantly affect the flying trajectories of discharged droplets. Thus, the prescribed gray scale value corresponding to the threshold to which the upper limit value of the nozzle duty is applied and the upper limit value of the nozzle duty are changed according to the distance between the recording head and the recording medium to reduce, according to the more appropriate condition, the intensity of airflows occurring under the effect of discharge of droplets.

The recording device described above further preferably includes an input unit configured to input an upper limit value change instruction, wherein the recording controller is configured to change the upper limit value and the prescribed gray scale value, based on the upper limit value change instruction received from the input unit, to control the recording.

According to this configuration, the recording device includes the input unit configured to input the upper limit value change instruction, and the recording controller changes the upper limit value and the prescribed gray scale value and controls the recording, based on the upper limit value change instruction received from the input unit. This allows more appropriate adjustment of the condition for reducing the intensity of airflows occurring under the effect of discharge of droplets.

An aspect of the application provides a recording method for recording a recording image by discharging droplets onto a recording medium from a recording head with multiple nozzles, configured to discharge droplets onto the recording medium, arranged therein while the recording head and the recording medium are moved relative to each other, the recording method including executing the recording on condition that, for pixel data of the recording image that have a prescribed gray scale value or larger, a nozzle duty corresponding to the number of nozzles, included in the multiple nozzles and being able to discharge the droplets per unit area on the recording medium, is smaller than or equal to an upper limit value and on condition that a discharge amount of the droplets discharged per the unit area is variable.

According to this method, for the pixel data of the recording image having the prescribed gray scale value or larger, the nozzle duty corresponding to the number of nozzles included in the multiple nozzles and being capable of discharging the droplets per unit area on the recording medium is smaller than or equal to the upper limit value. This enables a reduction in the intensity of airflows occurring on a recording surface of the recording medium under the effect of discharge of droplets. As a result, possible wind ripples and the like are suppressed, thus allowing recording quality to be improved.

Furthermore, for the pixel data of the recording image having the prescribed gray scale value or larger, the discharge amount of droplets discharged per unit area is variable in conjunction with the nozzle duty smaller than or equal to the upper limit value. This allows the gray scales of the recording image to be expressed even though the number of nozzles capable of discharging droplets is limited to suppress possible wind ripples and the like.

This application claims priority under 35 U.S.C. § 119 to Japanese Patent Application No. 2018-061406, filed Mar. 28, 2018. The entire disclosure of Japanese Patent Application No. 2018-061406 is hereby incorporated herein by reference.

What is claimed is:

1. A recording device comprising:

a recording head including multiple nozzles arranged therein to discharge droplets onto a recording medium; and a recording controller configured to control recording of a recording image, the recording including moving the recording head relative to the recording medium while the droplets are discharged, wherein the recording controller is configured to control the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable, and wherein the recording controller is further configured to change the prescribed gray scale value and the upper limit value, depending on a distance between the recording head and the recording medium, to control the recording.

2. The recording device according to claim 1, wherein the recording controller is configured to control the recording under a condition that, for the pixel data having the prescribed gray scale value or larger, the nozzle duty is constant.

3. The recording device according to claim 1, wherein the recording controller is configured to control the recording under a condition that, for the pixel data having the prescribed gray scale value or larger, a size of the droplet is increased in accordance with an increase in a gray scale value of the recording image.

4. A recording device comprising:

a recording head including multiple nozzles arranged therein to discharge droplets onto a recording medium;

a recording controller configured to control recording of a recording image, the recording including moving the recording head relative to the recording medium while the droplets are discharged; and an input unit configured to input an upper limit value change instruction, wherein the recording controller is configured to control the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable; and wherein the recording controller is configured to change the upper limit value and the prescribed gray scale value, based on the upper limit value change instruction received from the input unit, to control the recording.

5. A recording method for recording a recording image by discharging droplets from a recording head including multiple nozzles, configured to discharge droplets onto a recording medium, arranged therein while the recording head and the recording medium are moved relative to each other, the recording method comprising executing the recording for pixel data of the recording image that have a prescribed gray scale value or larger under conditions that a nozzle duty corresponding to the number of nozzles, included in the multiple nozzles and being able to discharge the droplets per unit area on the recording medium, is smaller than or equal to an upper limit value and that a discharge amount of the droplets discharged per the unit area is variable;

wherein the recording controller is further configured to change the prescribed gray scale value and the upper limit value, depending on a distance between the recording head and the recording medium, to control the recording.

* * * * *